US010608330B2

(12) United States Patent
Talty et al.

(10) Patent No.: US 10,608,330 B2
(45) Date of Patent: Mar. 31, 2020

(54) METHOD AND APPARATUS TO CONCEAL NEAR TRANSPARENT CONDUCTORS

(71) Applicant: GM GLOBAL TECHNOLOGY OPERATIONS LLC, Detroit, MI (US)

(72) Inventors: Timothy J. Talty, Beverly Hills, MI (US); Hyok Jae Song, Oak Park, CA (US); James H. Schaffner, Chatsworth, CA (US); Duane S. Carper, Davison, MI (US); Eray Yasan, Canton, MI (US)

(73) Assignee: GM GLOBAL TECHNOLOGY OPERATIONS, LLC, Detroit, MI (US)

( * ) Notice: Subject to any disclaimer, the term of this patent is extended or adjusted under 35 U.S.C. 154(b) by 217 days.

(21) Appl. No.: 15/811,867

(22) Filed: Nov. 14, 2017

(65) Prior Publication Data

US 2019/0148821 A1 May 16, 2019

(51) Int. Cl.

| | |
|---|---|
| ***H01Q 1/32*** | (2006.01) |
| ***H01Q 1/48*** | (2006.01) |
| ***H01Q 19/10*** | (2006.01) |
| ***H01Q 1/36*** | (2006.01) |
| ***H01Q 1/12*** | (2006.01) |
| *H01Q 9/04* | (2006.01) |

(52) U.S. Cl.

CPC ..... *H01Q 1/325* (2013.01); *H01Q 1/1271* (2013.01); *H01Q 1/36* (2013.01); *H01Q 1/48* (2013.01); *H01Q 19/10* (2013.01); *H01Q 9/0407* (2013.01)

(58) Field of Classification Search

CPC ..... H01Q 1/325; H01Q 1/1271; H01Q 1/36; H01Q 1/48; H01Q 19/10

USPC ..... 343/713

See application file for complete search history.

(56) References Cited

U.S. PATENT DOCUMENTS

| | | | | |
|---|---|---|---|---|
| 4,260,989 | A * | 4/1981 | Ishii | H01Q 1/1278 219/203 |
| 2004/0257286 | A1* | 12/2004 | Iijima | H01Q 1/1278 343/713 |
| 2006/0202898 | A1* | 9/2006 | Li | H01Q 1/1271 343/713 |
| 2007/0120757 | A1* | 5/2007 | Ogino | H01Q 1/1271 343/713 |
| 2010/0026590 | A1* | 2/2010 | Chiang | H01Q 1/1271 343/702 |
| 2010/0171670 | A1* | 7/2010 | Jesson | H01Q 1/32 343/713 |
| 2012/0154229 | A1* | 6/2012 | Kagaya | H01Q 1/1271 343/713 |
| 2015/0222006 | A1* | 8/2015 | Dai | H01Q 1/1271 343/712 |
| 2016/0006112 | A1* | 1/2016 | Kagaya | H01Q 1/1285 343/712 |

* cited by examiner

*Primary Examiner* — Huedung X Mancuso
(74) *Attorney, Agent, or Firm* — Lorenz & Kopf, LLP

(57) ABSTRACT

The present application generally relates to antennas embedded in or on glass structures. More specifically, the application teaches a method and apparatus for camouflaging near-transparent conductors by adding additional conductive or non-conductive materials of non-conductive areas by applying the additional materials in the same plane or a different plane than the antenna.

10 Claims, 4 Drawing Sheets

METHOD AND APPARATUS TO CONCEAL NEAR TRANSPARENT CONDUCTORS

BACKGROUND

The present application generally relates to antennas embedded in or on glass structures. More specifically, the application teaches a method and apparatus for camouflaging near-transparent conductors by adding additional conductive or non-conductive materials of non-conductive areas.

BACKGROUND INFORMATION

Glass structures are a convenient location to mount antennas and other conductors. Glass structures are nonconductive and facilitate a greater variety of radiation patterns and directivity for designers. Optically near-transparent conductors are available in many forms such as indium tin oxide, zinc oxide base transparent conductive films and nanowires. A state of the art transparent conductor made from a random network of nanowires has shown a sheet resistance of less than 0.1 ohm with optical transmission better than 70%. However, these near transparent conductors are still visible and may be a distraction to occupants of a vehicle. It would be desirable to optically camouflage antennas embedded in or on glass structures.

SUMMARY

Embodiments according to the present disclosure provide a number of advantages. For example, embodiments according to the present disclosure may enable embedding transparent conductive films in glass in the field of view, enable larger areas of the glass to be used as a design surface, and provide additional degrees of freedom when designing transparent conductive devices.

In accordance with an aspect of the present invention, an apparatus comprising a transparent substrate having a first side and a second side, a planar antenna formed of the first side of the transparent substrate, and a camouflaging material formed on the second side of the transparent substrate such that the camouflaging material overlaps the planar antenna in an orthogonal direction.

In accordance with another aspect of the present invention, a vehicular antenna comprising a window having an interior side and an exterior side, an antenna formed of the exterior side of the window, and a camouflaging material formed on the interior side of the window such that the camouflaging material overlaps the planar antenna when viewed through the window.

The above advantage and other advantages and features of the present disclosure will be apparent from the following detailed description of the preferred embodiments when taken in connection with the accompanying drawings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DETAILED DESCRIPTION

The following detailed description is merely exemplary in nature and is not intended to limit the disclosure or the application and uses thereof. Furthermore, there is no intention to be bound by any theory presented in the preceding background or the following detailed description. For example, the circuitry, transmission lines and antennas of the present invention has particular application for use on a vehicle. However, as will be appreciated by those skilled in the art, the invention may have other applications.

Figure 1:
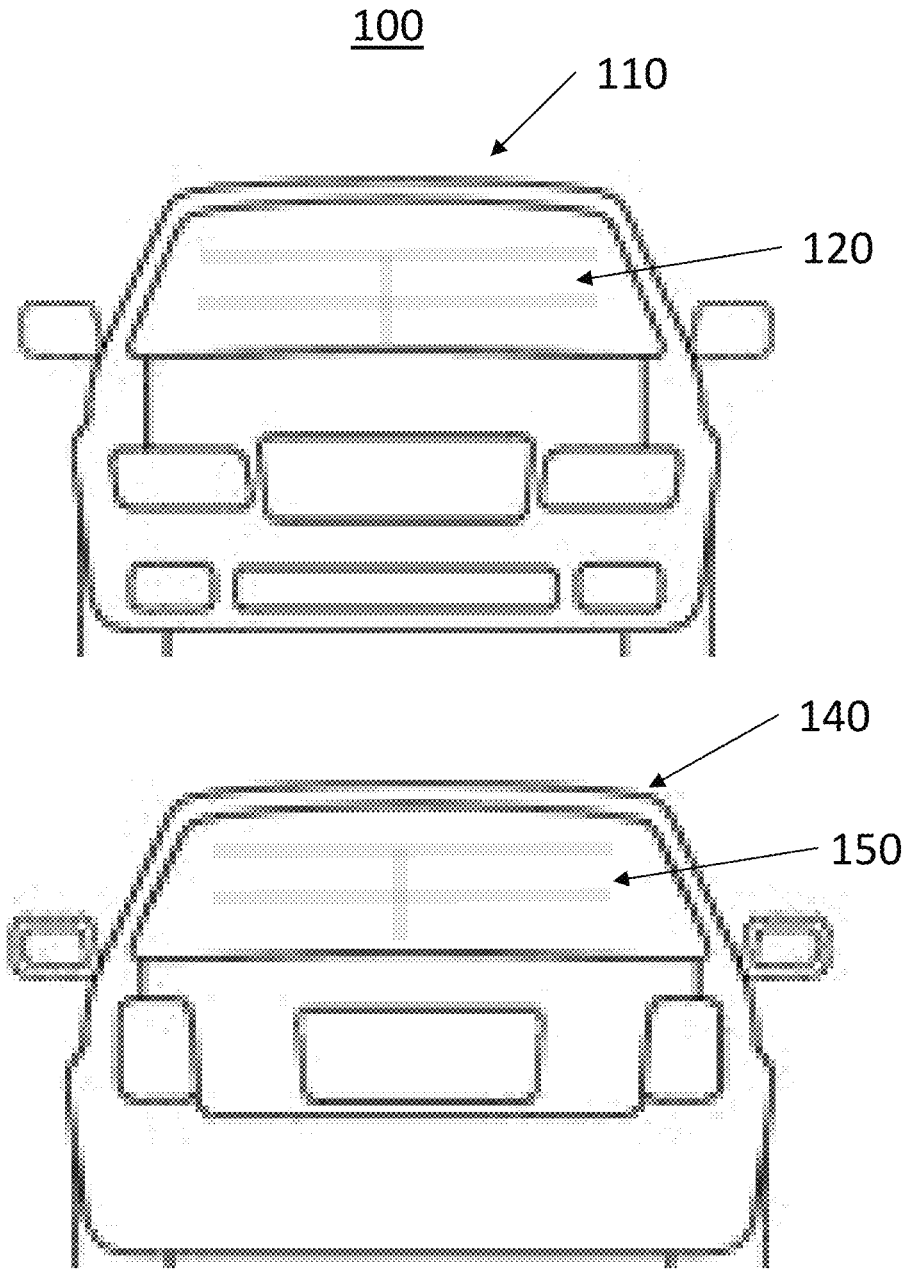
FIG. 1 is a schematic diagram of an exemplary application of the semitransparent antenna and transmission lines in an automotive environment, according to an embodiment.

FIG. 1 schematically illustrates an exemplary application of the semitransparent antenna and transmission lines in an automotive environment 100. The exemplary embodiment proposes a system for semi-transparent and flexible millimeter wave circuits and antennas using inexpensive PET substrate. The system facilitates the fabrication of millimeter wave circuits, transmission lines and antennas in various optically transparent platform where optical transparency is desired, for example in automotive radar in windows, windshield, and rear/side mirrors. An exemplary application is an antenna 120 applied to the the front windshield 110 of a vehicle. The front windshield 110 provides a large uninterrupted non conducting surface on which to place an antenna 120. However, the antenna structure 120 must be sufficiently transparent in order not to obstruct the driver view. A second application is shown with a second antenna 150 affixed to a rear window 140 of a vehicle. Again, the second antenna 150 must have sufficient trasparency as to not obstruct the driver's view.

Figure 2:
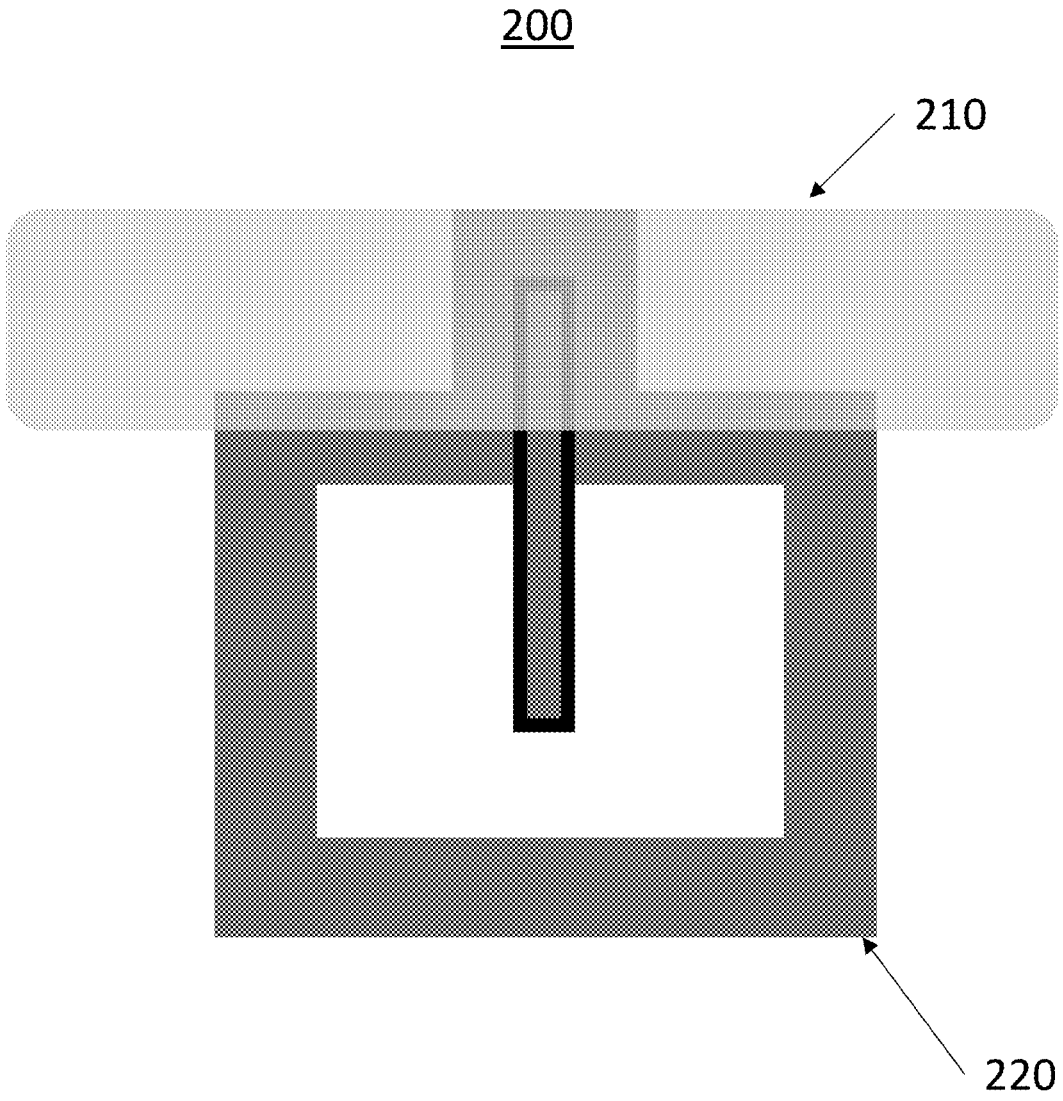
FIG. 2 is an exemplary antenna design according to an embodiment.

Turning now to FIG. 2, an exemplary antenna design 200 according to the present disclosure is shown. The antenna 220 shown is a planar antenna mounted on, or embedded in, glass for this exemplary embodiment. The antenna is mounted in an alternate plane that a ground plane 210. The antenna 220 has conductive areas interspersed with and non-conductive areas. The transition from conductive to non-conductive areas can result in optical artifacts. It is therefore desirable to camouflage the transition between the conductive and non conductive areas in order to limit the optical artifacts.

Figure 3:
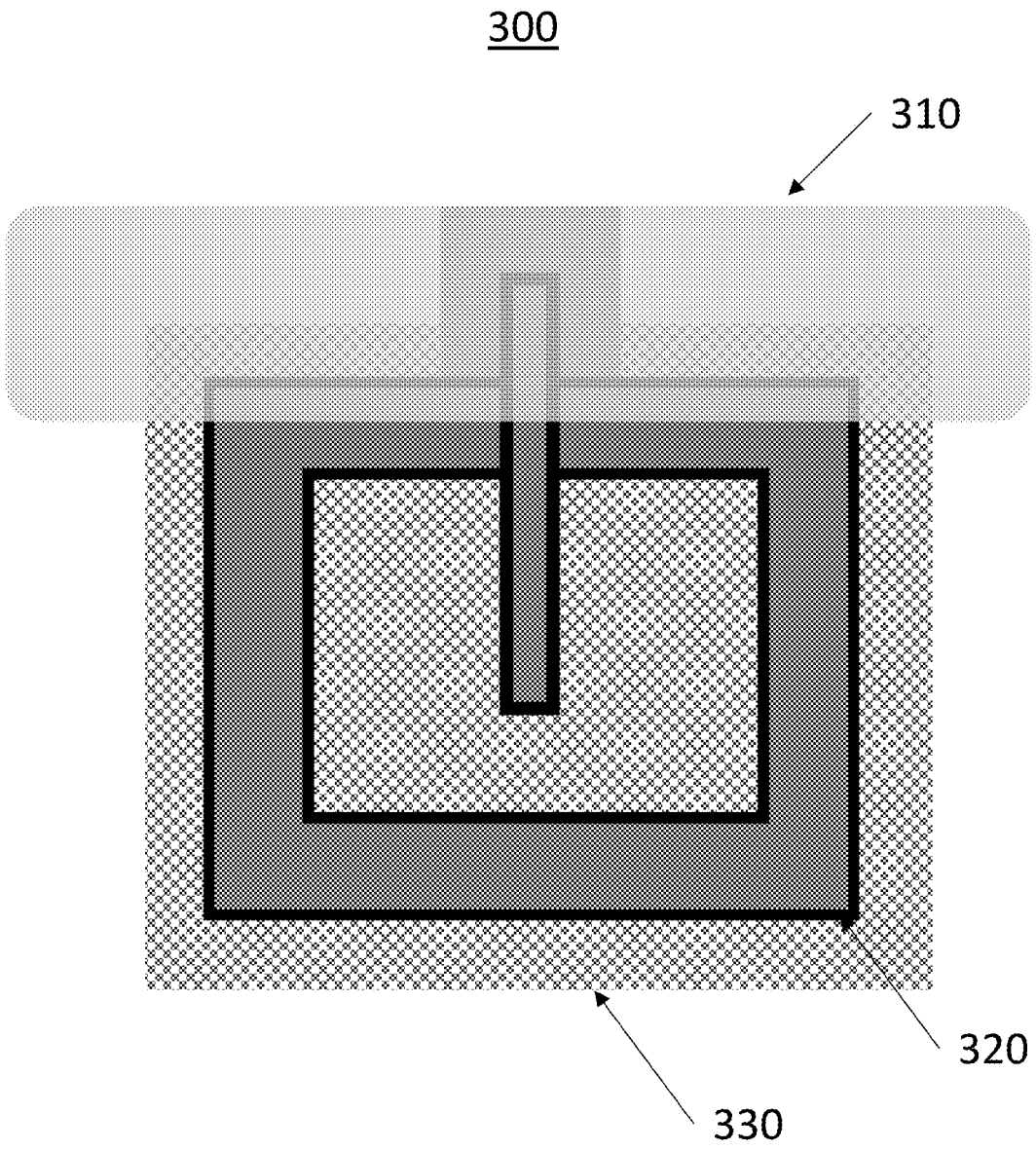
FIG. 3 is an alternate exemplary antenna design according to an embodiment.

Turning now to FIG. 3, an exemplary camoflaged antenna design 300 according to the present disclosure is shown. The exemplary antenna 320 is shown interspersed with material 330 on the same plane as the planar antenna. The material 320 may be either conductive or non-conductive and is used to conceal the conductive and non-conductive areas. The material 330 may be applied with a gradient to further assist concealing/camouflaging the antennas. In this exemplary embodiment, the ground plane 310 is located in a different plane than the material 330 and the antenna 320. In an exemplary manufacturing processes a subtractive process may be used. In a subtractive process, the conductive coating is deposited on the entire glass surface. To create antenna structures, material is removed to create the non-conductive area. In these situations, less material would need to be removed thereby reducing material removed and potentially reduce glass manufacturer's processing time.

Figure 4:
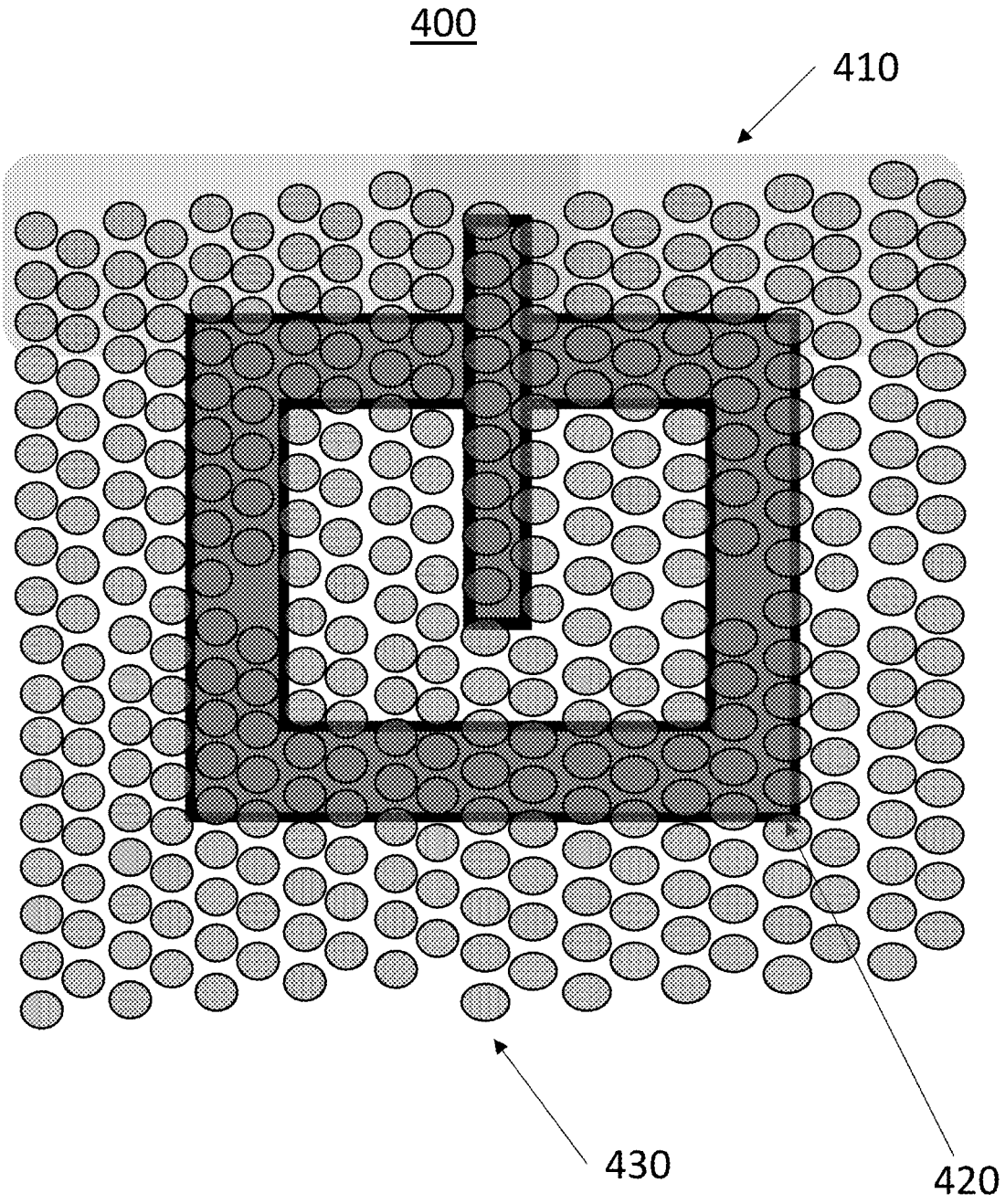
FIG. 4 is an alternate exemplary antenna design according to an embodiment.

FIG. 4 shows an alternate exemplary camoflaged antenna design 300 according to the present disclosure. In this exemplary embodiment, material 430 is added in a different plane than the antenna 420. For example, the antenna 420 may be applied on one side of a glass windshield and the material 430 may be applied to the other side of the windshield. The material 430 may be either conductive or non-conductive and is used to conceal the conductive and non-conductive areas of the antenna 420 and the ground plane 410 if applicable. The additional material may be applied with a gradient to further assist concealing/camouflaging the antennas. The material 420 may be applied in patterns selected to augment the radiation pattern of the antenna 420 in the case of conductive material. Alternatively, the material 430 pattern may be selected to minimize optical artificats from the material 430 and the antenna 420 and to limit distraction to a driver. In an alternate embodment, the camoflaging material may be a wire grid reflector such that the directional gain of the antenna is improved.

The invention claimed is:

1. An apparatus comprising:

a transparent substrate having a first side and a second side;

a planar antenna formed of the first side of the transparent substrate; and a camouflaging material formed on the second side of the transparent substrate such that the camouflaging material overlaps the planar antenna in an orthogonal direction wherein the camouflaging material is formed from a pattern of shapes smaller than a resonant wavelength of the planar antenna.

2. The apparatus of claim 1 wherein the first side and the second side are parallel.

3. The apparatus of claim 1 wherein transparent substrate is a vehicle windshield.

4. The apparatus of claim 1 wherein transparent substrate is glass.

5. The apparatus of claim 1 further comprising a ground plane formed on the second side of the transparent substrate.

6. A vehicular antenna comprising:

a window having an interior side and an exterior side;

an antenna formed of the exterior side of the window; and a camouflaging material formed on the interior side of the window such that the camouflaging material overlaps the planar antenna when viewed through the window wherein the camouflaging material is formed from a pattern of shapes smaller than a resonant wavelength of the antenna.

7. The vehicular antenna of claim 6 wherein the interior side and the exterior side are parallel.

8. The vehicular antenna of claim 6 wherein window is a windshield.

9. The vehicular antenna of claim 6 wherein the antenna is a planar antenna.

10. The vehicular antenna of claim 6 further comprising a ground plane formed on the interior side of the window.

* * * * *